US006544017B1

(12) United States Patent
Skinner

(10) Patent No.: US 6,544,017 B1
(45) Date of Patent: Apr. 8, 2003

(54) REVERSE ROTATION BRAKE FOR SCROLL COMPRESSOR

(75) Inventor: Robin G. Skinner, Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/087,687

(22) Filed: Oct. 22, 2001

(51) Int. Cl.[7] ..... F04C 18/04; F04C 29/10
(52) U.S. Cl. ..... 418/55.1; 418/1; 418/69
(58) Field of Search ..... 418/1, 55.1, 69, 418/181

(56) References Cited

U.S. PATENT DOCUMENTS

| | | | | |
|---|---|---|---|---|
| 2,035,096 | A | 3/1936 | Schneider | 74/389 |
| 2,300,223 | A | 10/1942 | Hottenroth, Jr. | 192/45 |
| 2,372,026 | A | 3/1945 | Smith | 188/82 |
| 2,569,108 | A | 9/1951 | Koch | 188/82.84 |
| 2,824,625 | A | 2/1958 | Rice, Jr. | 188/82.84 |
| 2,962,128 | A | 11/1960 | Luenberger | 188/82.84 |
| 3,633,713 | A | 1/1972 | Marland et al. | 188/82.84 |
| 3,656,591 | A | 4/1972 | Marland et al. | 188/82.84 |
| 4,350,235 | A | 9/1982 | Brownett | 192/45 |
| 4,998,864 | A | 3/1991 | Muir | 417/410 |
| 5,199,857 | A | 4/1993 | Sanuki | 417/319 |
| 5,276,945 | A | 1/1994 | Matsumura | 16/337 |
| 5,306,126 | A | 4/1994 | Richardson, Jr. | 418/1 |
| 5,320,507 | A | 6/1994 | Monnier et al. | 418/55.6 |
| 5,433,589 | A | 7/1995 | Wada et al. | 418/55.5 |
| 5,447,419 | A | 9/1995 | Wada et al. | 418/55.5 |
| 5,474,434 | A | 12/1995 | Wada et al. | 418/55.5 |
| 5,490,769 | A | 2/1996 | Calhoun | 418/1 |
| 5,494,421 | A | 2/1996 | Wada et al. | 418/32 |
| 5,503,541 | A | 4/1996 | Barito et al. | 418/69 |
| 5,545,019 | A | 8/1996 | Beck et al. | 418/55.1 |
| 5,580,229 | A | 12/1996 | Beck et al. | 418/55.4 |
| 5,593,294 | A | 1/1997 | Houghtby et al. | 418/55.1 |
| 5,772,415 | A | 6/1998 | Monnier et al. | 418/14 |
| 6,015,277 | A | 1/2000 | Richardson, Jr. | 418/55.4 |
| 6,050,512 | A | 4/2000 | Jung | 242/247 |

FOREIGN PATENT DOCUMENTS

| | | | | |
|---|---|---|---|---|
| JP | 60-73078 | * | 4/1985 | 418/55.1 |

* cited by examiner

*Primary Examiner*—John J. Vrablik
(74) *Attorney, Agent, or Firm*—Baker & Daniels

(57) ABSTRACT

A scroll compressor including a housing having a compression mechanism and a motor disposed therein, rotatively coupled by a drive shaft. A crankcase is disposed in the housing and supports the compression mechanism. A brake element is operatively engaged with the crankcase with at least one roller located therebetween. The roller has a first position relative to the brake element and the crankcase when the compressor operated in a forward direction, in which forward motion of the orbiting scroll member is unimpeded. At the onset of reverse rotation, the roller has an assumed second position relative to one of the brake element and the crankcase, in which the roller is in binding engagement with the brake element and the crankcase to arrest reverse motion of the orbiting scroll member.

25 Claims, 8 Drawing Sheets

REVERSE ROTATION BRAKE FOR SCROLL COMPRESSOR

BACKGROUND OF THE INVENTION

The present invention relates to scroll compressors and more particularly to mechanisms provided to prevent reverse scroll rotation.

Scroll compressors include a compression mechanism having a fixed scroll member and an orbiting scroll member. The compression mechanism is operatively connected to a motor via a drive shaft. Upon energizing the motor, rotation of the drive shaft is induced which in turn causes "rotation" or orbiting motion of the orbiting scroll member. The orbiting scroll member revolves about the drive shaft axis of rotation, moving with respect to the fixed scroll member to compress refrigerant gas received between the scroll members. The compressed fluid is usually discharged from the scroll compression mechanism discharge port into the compressor housing and then from the compressor assembly to the remainder of the refrigerant system.

Upon compressor shut down or during a temporary interruption of power to the compressor, the orbiting scroll member is no longer driven by the motor via the drive shaft. The orbiting scroll member is free to move in response to pressure differentials existing between the suction and discharge ports of the compression mechanism as the compressed gas reexpands. If unimpeded, the reexpansion of already compressed fluid will act upon the orbiting scroll member, causing it to rotate in a reverse direction. If the reverse rotation is not stopped or prevented, objectionable noise and vibration may result. If power is restored to the motor while the drive shaft is rotating reversely, the motor may continue to drive the shaft and thus the orbiting scroll member in a reverse direction.

Previous methods are available which attempt to prevent prolonged reverse orbiting motion of the orbiting scroll member. One such method includes providing a discharge check valve over the outlet of the discharge port located in the fixed scroll member. The discharge check valve may prevent the back flow of compressed refrigerant fluid into the space between the orbiting and fixed scroll members, thereby reducing the opportunity for reverse rotation to occur. By preventing the return of compressed refrigerant fluid to the area between the scroll members, the oil entrained in the refrigerant fluid is not available to lubricate the scroll wraps should even temporary reverse rotation occur. If the scroll wraps are not lubricated, and reverse rotation is not prevented, wearing of abutting surfaces may occur. Further, continued reverse rotation of the compressor without lubrication may result in seizure of the compressor. The temperature within the compressor housing may also increase due to the fact that there is a lack of mass flow through the compressor. Prolonged reverse running is a particular concern where electrical power is temporarily interrupted, and restored while the drive shaft is still rotating in the reverse direction.

Alternatively, a one-way bearing may be provided about the drive shaft of the scroll compressor to prevent or arrest rotation in a direction other than the desired direction of the orbiting scroll member. Previous one-way bearings have rollers coupled to the drive shaft which are designed to be wedged between the drive shaft and the clutch or brake component when reverse rotation occurs. The reverse rotation of the drive shaft is stopped, as is the reverse orbiting motion of the orbiting scroll member. A problem with this type of device is that a load imparted to the drive shaft by the one-way bearing may contribute to energy losses, wearing of the drive shaft, and additional vibration during normal compressor operation. An additional problem is that existing one-way bearings may not be constructed to withstand both the loads created during compressor operation and the sudden load created upon compressor shut down.

It is desired to provide a reverse rotation brake for a scroll compressor which stops reverse rotation of the orbiting scroll member, which is able to withstand the sudden load created during compressor shut down, and which does not introduce additional loads to the drive shaft during normal compressor operation.

SUMMARY OF THE INVENTION

The present invention provides a reverse rotation brake which is operatively engaged with the compressor crankcase to arrest reverse rotation of the orbiting scroll member at the onset of reverse rotation, but which engage the crankcase with the orbiting scroll member or the drive shaft during normal compressor operation. In one embodiment, a brake element is located in a cavity provided in the crankcase, in surrounding relationship with the hub of the orbiting scroll member. Pockets are formed in the radially outer surface of the brake element to receive rollers. The pockets have flat portions along which the rollers roll when the orbiting scroll member rotates in a reverse direction to bindingly engage the brake element and the crankcase. The binding engagement of the rollers with both the crankcase cavity surface and the pocket flat portions thus arrests reverse rotation of the orbiting scroll member.

In a second embodiment, a brake element is secured to and supported by a compressor counterweight which is fixedly mounted to the drive shaft. The brake element is located in surrounding relationship with a radially outer surface of the crankcase. Pockets are formed in the outer surface of the crankcase to receive rollers which upon reverse rotation of the drive shaft, roll along the flat portions of the pockets to bindingly engage the brake element and the crankcase. Reverse rotation of the drive shaft, and thus the orbiting scroll member is arrested.

In a third embodiment, a brake element is cup-shaped and secured to one end of the drive shaft for rotation therewith. The end of the drive shaft is formed having a plurality of splines located about the periphery thereof which are engaged by a plurality of splines located about the periphery of a hole extending through the base of the brake element. Pockets having flat portions are formed in the outer surface of the brake element to receive rollers. The rollers roll along the flat portions when the orbiting scroll member rotates reversely to bindingly engage the brake element and the crankcase, and thus arrest the reverse rotation of the orbiting scroll member. With the brake element in binding engagement with the crankcase, reverse rotation of the drive shaft is thus arrested through the splined engagement between the brake element and the drive shaft.

In accordance with the present invention, the load opposing reverse rotation is borne by the brake element and the crankcase, but not the drive shaft. Nor is the shaft subjected to loading by the inventive brake during normal compressor operation. Further, the brake engages existing, robust portions of the compressor which are able to withstand both the operational loads and the sudden load thereon created upon compressor shut down.

Further, radial compliance of the scroll members is maintained even with the reverse rotation brake installed.

The present invention provides a scroll compressor having a housing and a compression mechanism including a fixed scroll member and an orbiting scroll member disposed therein. A motor is disposed in the housing and is operatively coupled to the compression mechanism via a drive shaft. A crankcase is disposed in the housing and is connected to the compression mechanism. A brake element is operatively engaged with the crankcase, with at least one roller located therebetween. The brake roller has a first position relative to one of the brake element and the crankcase when the compressor operates in a forward direction, in which forward rotation of the orbiting scroll member is unimpeded. At the onset of reverse orbiting scroll member motion, the roller assumes a second position relative to the brake element or crankcase in which the roller is in binding engagement with the brake element and the crankcase, whereby reverse motion of the orbiting scroll member is arrested.

The present invention also provides a scroll compressor having a housing in which a motor and a compression mechanism, including a fixed scroll member and an orbiting scroll member, are disposed. A drive shaft rotatively couples the motor and the compression mechanism. A crankcase is disposed in the housing and is connected to the compression mechanism. A brake element is located between the orbiting scroll member and the crankcase, with at least one roller located between the brake element and the crankcase. The brake element has a substantially cylindrical outer surface in which at least one pocket is formed. The roller is disposed in the pocket. The roller has a first position in the pocket in which rotation of the orbiting scroll member is unimpeded when the compressor operates in a forward direction. At the onset of reverse motion of the orbiting scroll member, the roller assumes a second position in the pocket in which the roller is in binding engagement with the brake element and the crankcase, whereby reverse motion of the orbiting scroll member is arrested.

The present invention also provides a scroll compressor including a compressor housing having a compression mechanism including a fixed scroll member and an orbiting scroll member disposed therein. A motor is also disposed in the housing and is operatively coupled to the compression mechanism via a drive shaft. A crankcase is disposed in the housing and is connected to the compression mechanism. The crankcase includes at least one pocket being formed therein. A brake element is rotatably fixed to the drive shaft. A roller is received in the pocket and has a first position in the pocket in which forward motion of the orbiting scroll member is unimpeded when the compressor is operated in a forward direction. At the onset of reverse motion of the orbiting scroll member, the roller assumes a second position in the pocket in which the roller bindingly engages the brake element and the crankcase to arrest reverse motion of the orbiting scroll member.

The present invention provides a scroll compressor comprising a compressor housing having a compression mechanism, including a fixed scroll member and an orbiting scroll member, disposed therein. A motor located in the housing is operatively coupled to the compression mechanism via a drive shaft. The compression mechanism is connected to a crankcase disposed in the housing. A brake element is fixedly coupled to the drive shaft, located between the orbiting scroll member and the crankcase. At least one roller is located between the brake element and the crankcase. The brake element has a substantially cylindrical outer surface in which at least one pocket is formed to receive the roller. The roller has a first position in the pocket in which forward motion of the orbiting scroll member is unimpeded when the compressor operates in a forward direction. At the onset of reverse motion of the orbiting scroll member, the roller has an assumed second position in the pocket in which the roller is in binding engagement with the brake element and the crankcase, whereby reverse motion of the orbiting scroll member is arrested.

The present invention provides a method of arresting reverse motion of the orbiting scroll of a scroll compressor. The method includes moving an orbiting scroll member of a compression mechanism of the scroll compressor in a forward direction while rotating a brake element in the forward direction relative to the compressor crankcase; maintaining at all times a movable contact element in contact with one of the brake element and the compressor crankcase; initiating reverse motion of the orbiting scroll member; moving the movable contact element into binding engagement with the brake element and the crankcase while initiating rotation of the brake element in the reverse direction; and arresting reverse rotation of the orbiting scroll member.

BRIEF DESCRIPTION OF THE DRAWINGS

The above-mentioned and other features and advantages of this invention, and the manner of attaining them, will become more apparent and the invention itself will be better understood by reference to the following description of the embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
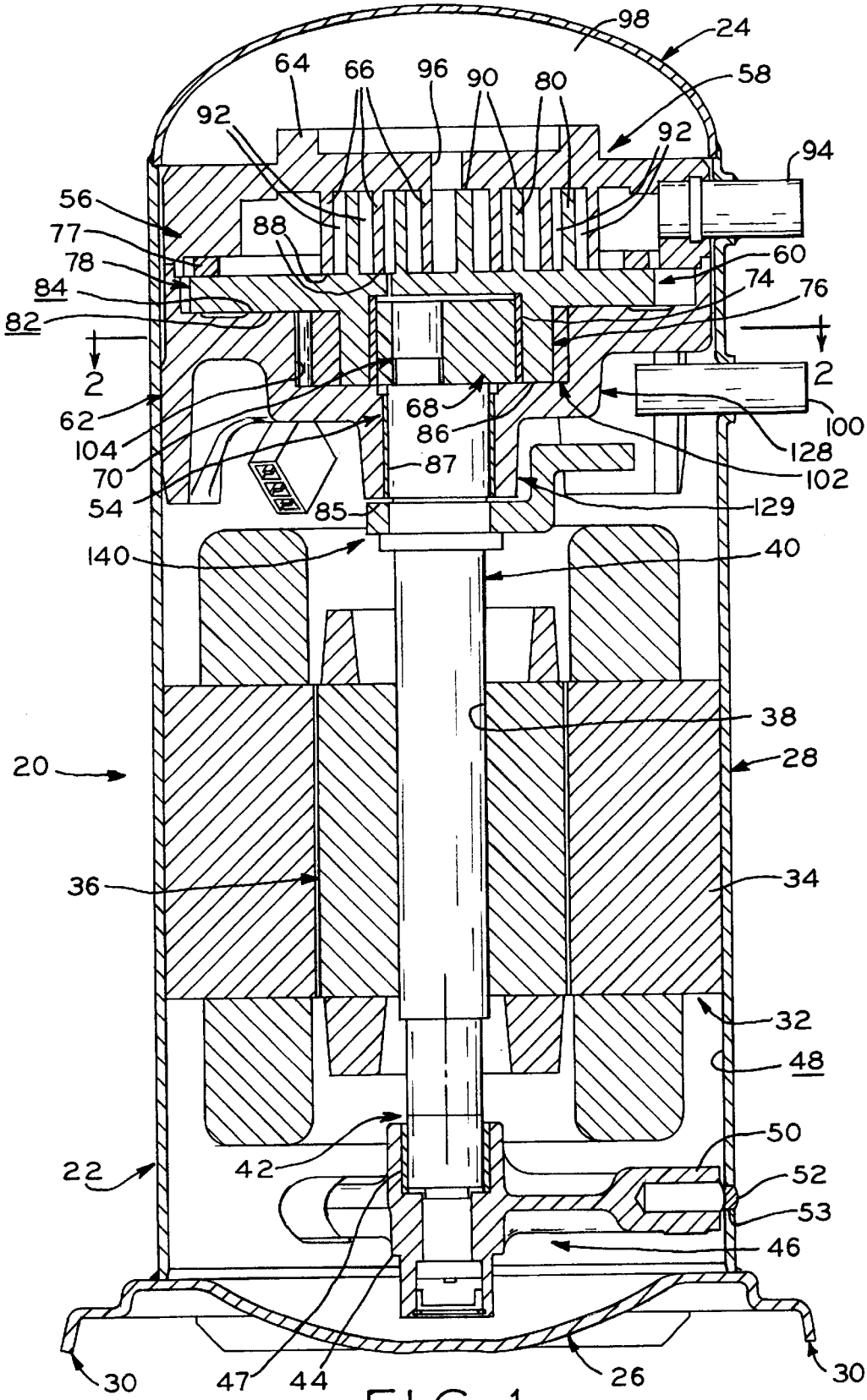
FIG. 1 is a sectional side view of a compressor assembly in accordance with a first embodiment of the present invention.

Referring to FIG. 1, hermetic compressor assembly 20 includes housing 22 having upper and lower portions 24 and 26 located at opposite ends of cylindrical central portion 28. Housing portions 24, 26, and 28 are hermetically sealed by any suitable method including welding, brazing, or the like. Compressor 20 is substantially vertically arranged and is supported by legs 30 of lower housing portion 26.

Located within housing 22 is electric motor 32 including stator 34 and rotor 36. Aperture 38 is located centrally through rotor 36 for receiving drive shaft 40 which is interference fitted therein for rotation with rotor 36. Lower end 42 of drive shaft 40 is rotatably received in central collar 44 of outboard bearing 46 mounted near the lower end of central housing portion 28. Shaft lower end 42 is supported within bearing collar 44 by bearing 47. Outboard bearing 46 is provided with three legs 50, only one of which is shown, radially extending from central collar 44. Each leg 50 is secured to inner surface 48 of central housing portion 28 by weld pin 52 which is secured by weld 53 to central housing portion 28 and extends into leg 50.

Compressor 20 is a scroll-type compressor having compression mechanism 56 operatively coupled to upper end 54 of drive shaft 40. The general operation of a scroll compressor is described in U.S. Pat. Nos. 5,306,126 and 6,015,277, the disclosures of which are hereby expressly incorporated herein by reference. Scroll compression mechanism 56 is supported by main bearing frame member or crankcase 62 and includes fixed scroll member 58 and orbiting scroll member 60. Fixed scroll member 58 includes flat plate 64 and orbiting scroll member 60 includes flat plate 78. Fixed scroll wrap 66 and orbiting scroll wrap 80 extend approximately perpendicularly from respective flat plates 64 and 78. Compression mechanism 56 is assembled such that fixed scroll wrap 66 and orbiting scroll wrap 80 intermesh. Back surface 82 of flat plate 78 interfaces crankcase thrust bearing surface 84.

Figure 6:
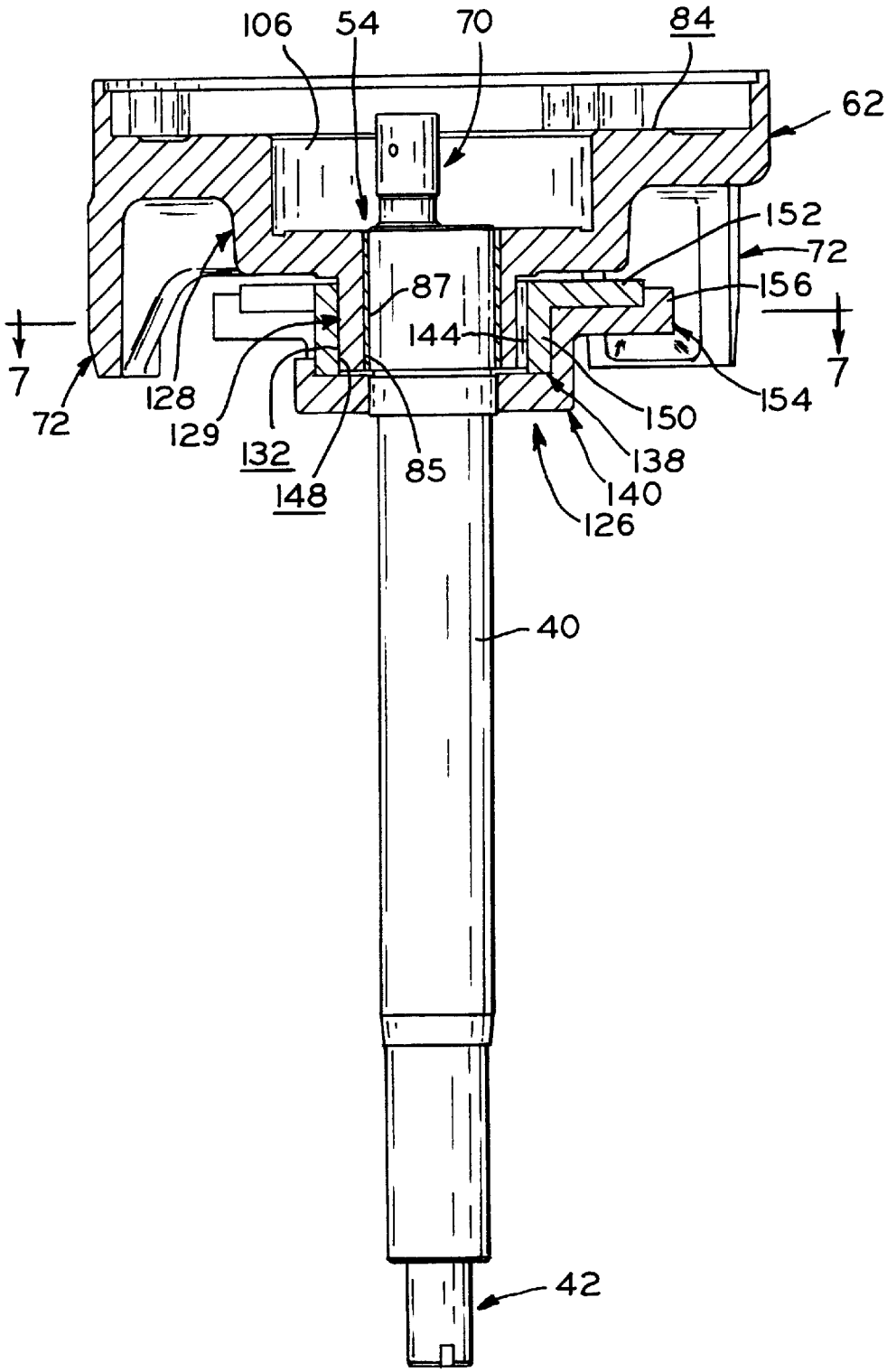
FIG. 6 is a sectional view of the brake assembly of FIG. 5.

Referring to FIGS. 1–6, and 9, crankcase 62 has substantially cylindrical central portions 128 and 129. Central portion 129 is of a radially smaller size than central portion 128. Three legs 72 radially extend from central portion 128 to be secured to inner surface 48 of central housing portion 28 by any suitable fastening method, including, for example, shrink-fitting or welding. In the first and third embodiments of the present invention, central portion 128 defines a cavity in which is respectively received reverse rotation brake 102 and 158 as will be discussed hereinbelow. In a second embodiment of the present invention, central portion 129 has hole 85 extending therethrough in which shaft upper end 54 is rotatably supported by bearing 87 (FIG. 6). Reverse rotation brake 126 is engaged with crankcase central portion 129 as will be discussed hereinbelow.

Figure 9:
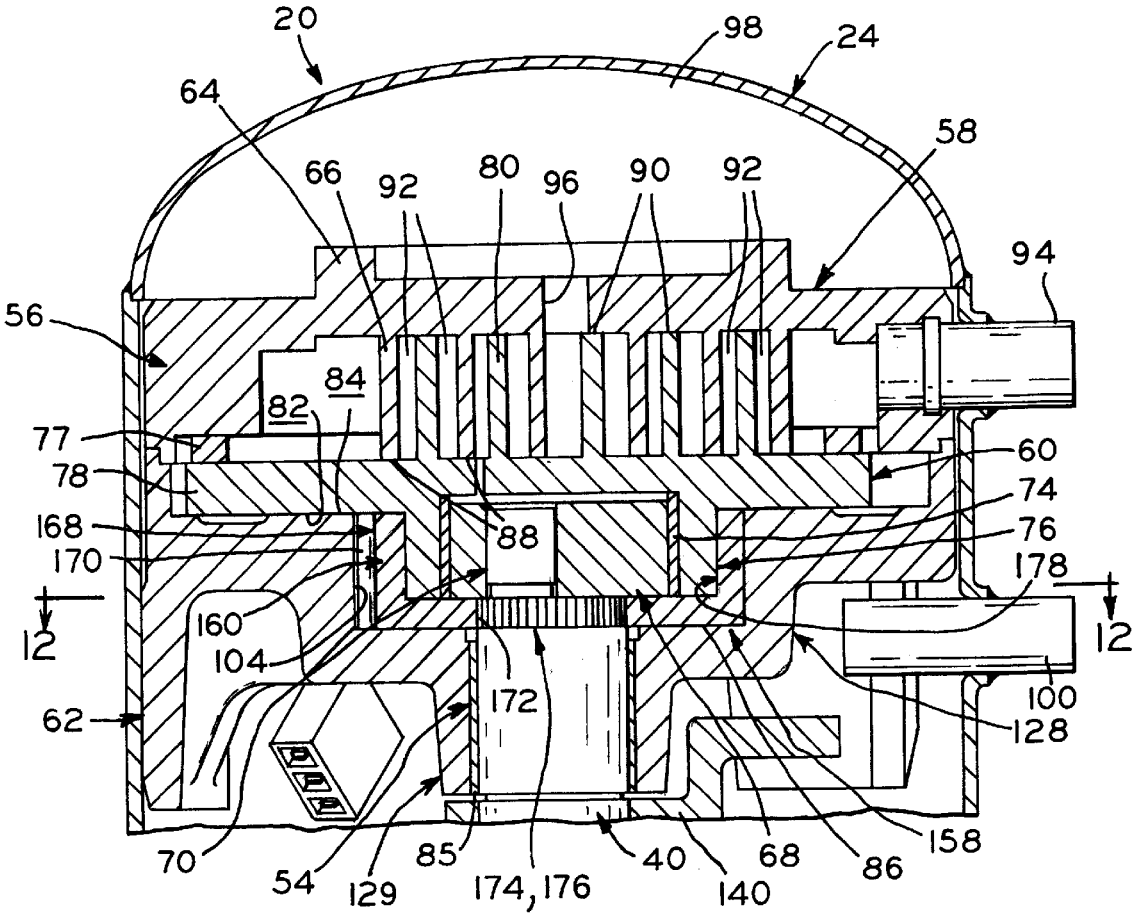
FIG. 9 is a sectional side view of a compressor assembly in accordance with a third embodiment of the present invention.
Figure 10:
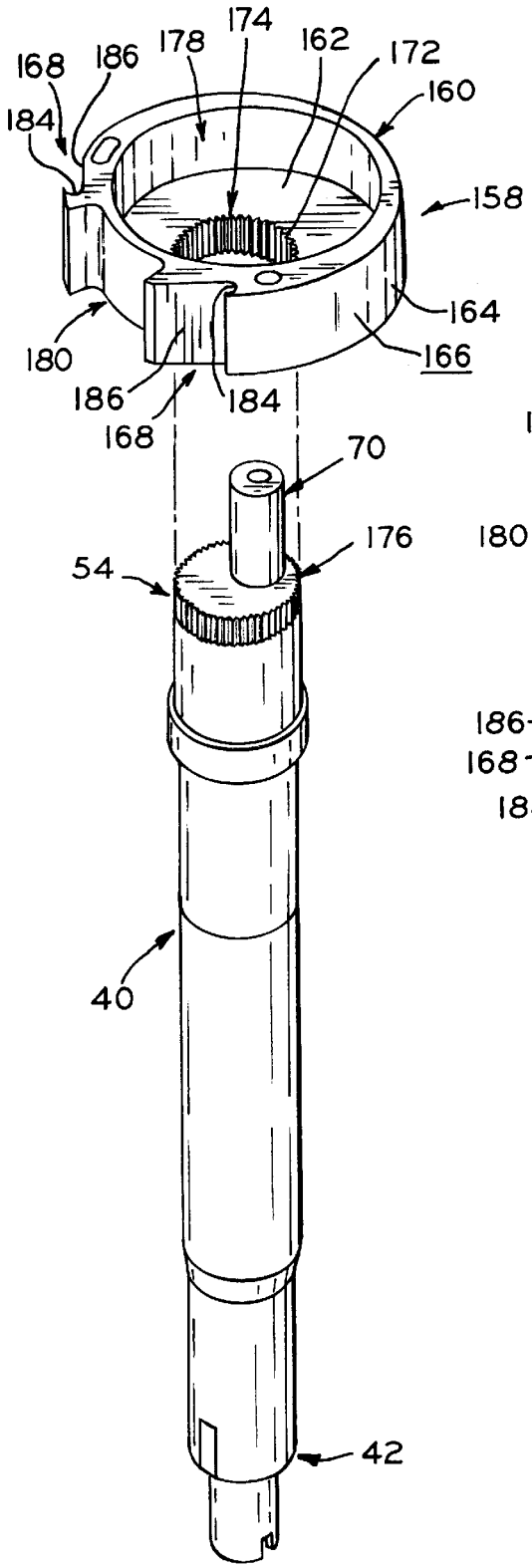
FIG. 10 is an exploded perspective view of the drive shaft and brake element of the brake assembly of the present invention.
Figure 11:
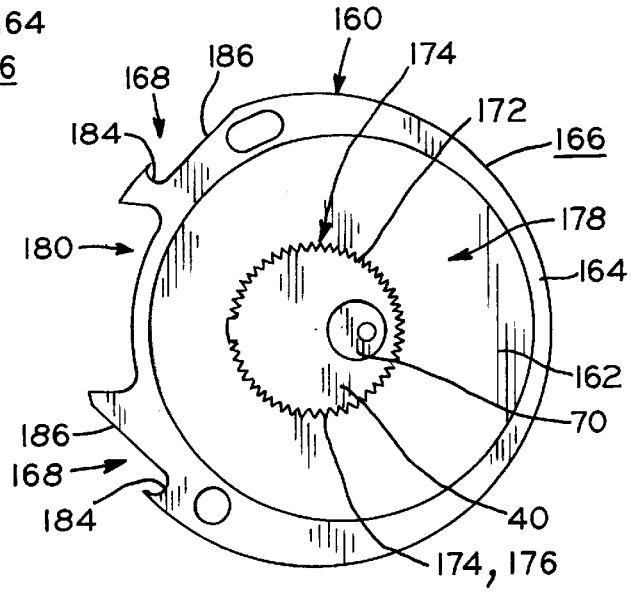
FIG. 11 is a top view of the brake element and drive shaft of FIG. 10.

In each embodiment described herein, fixed scroll member 58 is conventionally secured to crankcase 62 by mounting bolts (not shown). Referring to FIGS. 1 and 9, orbiting scroll member 60 is coupled to upper end 54 of drive shaft 40 through roller 68 and bearing 74. Orbiting scroll member 60 includes orbiting scroll member hub 76 downwardly extending from back surface 82 thereof. Cavity 86 is defined in orbiting scroll member hub 76 for receiving bearing 74 and roller 68, the latter of which is rotatably fixed about eccentric crankpin 70 integrally formed at upper end 54 of drive shaft 40. Bearing 74 surrounds roller 68 to allow roller 68 to rotate relative to hub 76 within cavity 86. Roller 68 is thus eccentric relative to the axis of rotation of shaft 40.

During compressor operation, motor 32 is energized, which induces rotation of rotor 36 and thus drive shaft 40. As roller 68 rotates about the axis of rotation of drive shaft 40, it and Oldham coupling 77 cause orbiting scroll member 60 to orbit with respect to fixed scroll member 58, and provide radial compliance to promote sealing engagement between the lateral sides of fixed scroll wrap 66 and orbiting scroll wrap 80. In any conventional manner, a biasing force may also act upon orbiting scroll member 60 to bias it axially against fixed scroll member 58, so that tips 88 and 90 of scroll wraps 66 and 80 sealingly engage flat plates 78 and 64, respectively, to define a plurality of sealed, crescent-shaped compression chambers 92.

Refrigerant fluid at suction pressure is drawn into the radially outermost compression chamber 92 through suction inlet tube 94 from the refrigeration system (not shown) which includes compressor 20. As orbiting scroll member 60 moves relative to fixed scroll member 58, refrigerant fluid captured within compression chambers 92 is compressed to discharge pressure. The refrigerant fluid progresses radially inwardly toward discharge port 96 located in fixed scroll member 58. The compressed fluid flows through discharge port 96 into discharge chamber 98 which occupies the interior of compressor housing 22. The discharge pressure fluid is then exhausted through discharge tube 100 back into the refrigeration system.

Upon compressor shut down, orbiting scroll member 60 is no longer orbitally driven by motor 32 via drive shaft 40, and orbiting scroll member 60 may begin to move in reverse in response to differences in gas pressures acting thereon, owing to the pressure differential which exists between discharge port 96 and suction inlet 94. The reexpansion of already compressed gas may act upon orbiting scroll member 60 to induce its reverse orbiting motion and reverse rotation of drive shaft 40. Unimpeded, the pressure differentials could cause orbiting scroll member 60 to orbit in a reverse direction with respect to fixed scroll member 58. Such reverse orbiting of scroll member 60 results in refrigerant fluid flowing through discharge port 96 back into compression chambers 92 and exiting through suction inlet 94 into the refrigeration system. Objectionable noise and vibration usually accompany such reverse orbiting motion of orbiting scroll member 60. If reverse rotation of orbiting scroll member 60 is not stopped, and power is subsequently restored to the motor, the compressor may continue to run in a reverse direction for a long period of time and, if lubricant is not provided to the bearing surfaces, the compressor will likely seize. Further, the temperatures between the scroll members may increase due to the lack of mass flow through the compression chambers, which may also result in damage to the compressor.

The present invention provides a reverse rotation brake including a brake element which is operatively engaged with crankcase 62 to arrest reverse rotation of orbiting scroll member 60.

Referring again to FIGS. 1–4, a first embodiment of the reverse rotation brake is illustrated. Reverse rotation brake 102 is positioned within cavity 104 formed in crankcase central portion 128 of crankcase 62. Brake 102 includes annular brake element 108 having pockets 110 formed in radially outer surface 112 thereof. Movable contact elements or rollers 114 of reverse rotation brake 102 are received in pockets 110, between brake element 108 and the cylindrical surface of crankcase 62 which defines cavity 104. Axially extending through brake element 108 is eccentric hole 106 into which orbiting scroll member hub 76 is received. Eccentric hole 106 is offset from the centerline of the outside diameter of center portions 128 and 129 of crankcase 62.

Brake element 108 of reverse rotation brake 102 is annular, but the eccentricity of surface 112 and hole 106 forms portion 109 which is radially thicker than the rest the circumference of brake element 108 and in which pockets 110 are located. Brake element 108 may be constructed using any suitable method including casting or powdered metal techniques, and pockets 110 may be formed or machined in portion 109. Pockets 110 include semicircular pocket portion 116 having flat portions or flats 118 extending therefrom and terminating at outer surface 112 of brake element 108. Brake element 108 is provided with two pockets 110, however, any other suitable number of pockets may be provided. Rollers 114 are cylindrical and have a diameter slightly smaller than that of semicircular pocket portion 116 of pocket 110, which allows rollers 114 to be easily moved into and out of semicircular pocket portions 116. Rollers 114 may be constructed from any suitable material, such as steel, which is of sufficient mass and able to withstand forces acting thereon during engagement and operation of the brake.

Figure 2:
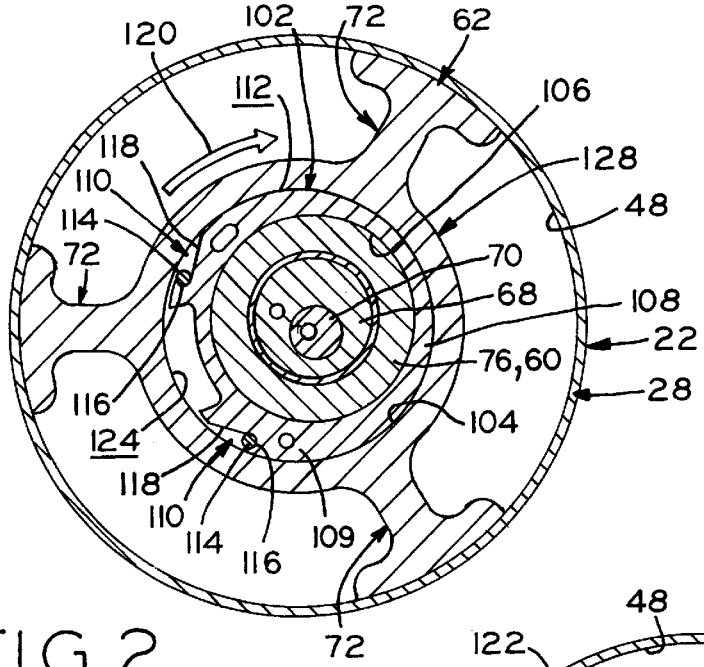
FIG. 2 is a sectional view of the compressor assembly of FIG. 1 along line 2—2 showing forward rotation.
Figure 3:
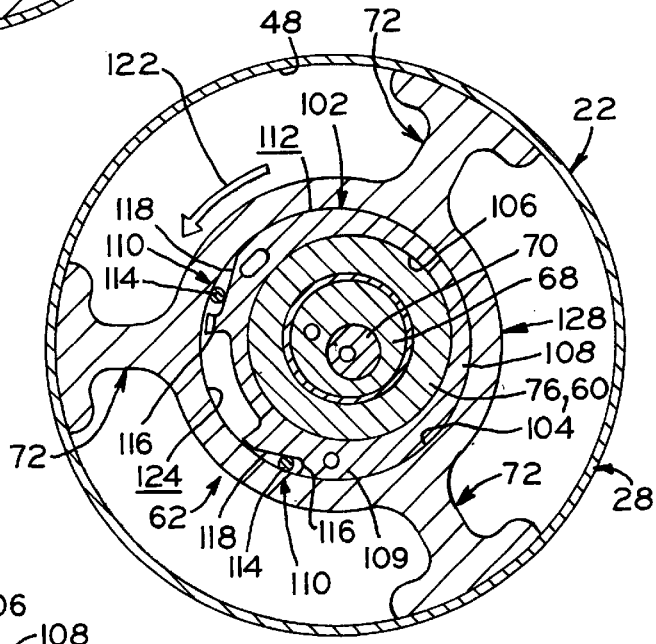
FIG. 3 is a sectional view of the compressor assembly of FIG. 2 showing arrested reverse rotation.
Figure 4:
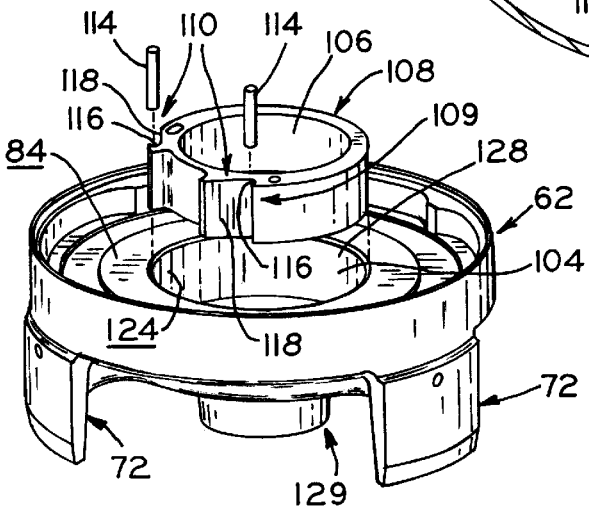
FIG. 4 is an exploded perspective view of the brake assembly of the compressor assembly of FIG. 1.
Figure 5:
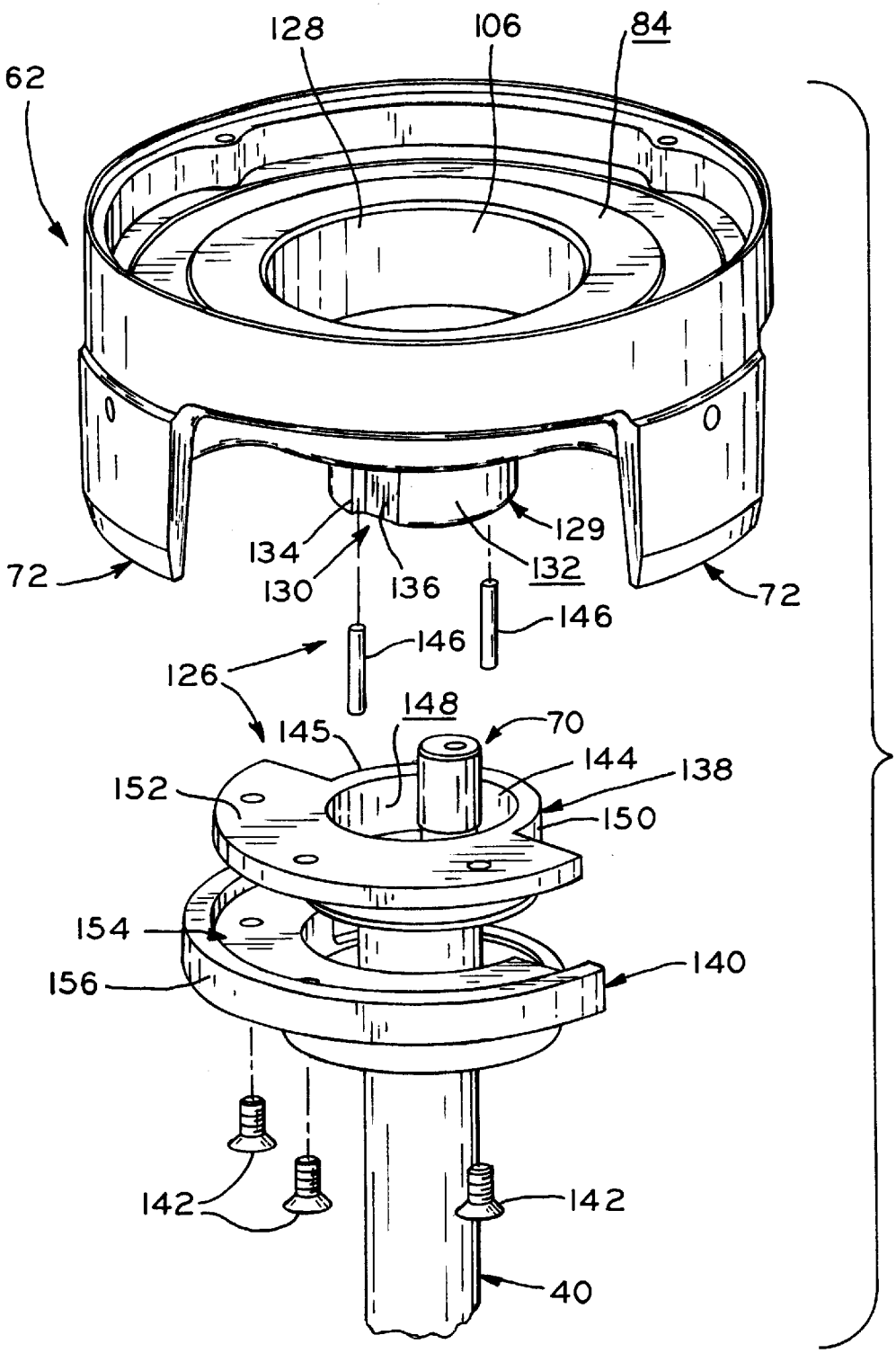
FIG. 5 is an exploded perspective view of a brake assembly of a compressor assembly in accordance with a second embodiment of the present invention.

Referring to FIG. 2, when hub 76 of orbiting scroll member 60 is rotated in a forward direction as indicated by arrow 120 shown in FIG. 2, rollers 114 are received in semicircular pocket portions 116. The orbiting motion of orbiting scroll member hub 76 imparts rotary motion to brake element 108 in a forward direction. During forward rotation, the movement of brake element 108 causes rollers 114 to remain within semicircular pocket portions 116 of pockets 110 and out of contact with crankcase portion 128 so as not to impede movement of orbiting scroll member 60. Referring to FIG. 3, when compressor 20 is shut down, reexpansion of compressed gas may cause hub 76 of orbiting scroll member 60 to move in a reverse direction indicated by arrow 122 (FIG. 3). At the onset of reverse rotation, the inertia of rollers 114 will cause them to roll out of semicircular pocket portions 116 along flats 118, after which they will engage flats 118 and cylindrical surface 124 of cavity 104, providing binding engagement therebetween. The binding engagement arrests reverse rotation of brake element 108, and thus of orbiting scroll member 60.

Referring to FIGS. 5–8, a second embodiment of the inventive reverse rotation brake is illustrated. Reverse rotation brake 126 includes brake element 138 having hole 144 extending therethrough. Crankcase central portions 128 and 129 downwardly extend from the underside of crankcase 62, with central portion 129 positioned in hole 144. Brake element 138 includes central collar portion 150 which defines hole 144, and flange 152 radially extending from upper end 145 of collar 150. Brake element 138 may be constructed using any suitable method including casting or powered metal techniques. Flange 152 is formed about approximately half of the perimeter of collar 150 and is provided for securing brake element 138 to counterweight 140. Alternatively, brake element 138 may be integrally formed with counterweight 140. Counterweight 140 is fixedly attached to drive shaft 40 for rotation therewith and includes flange 154 having lip 156. Flange 152 is seated on flange 154 adjacent lip 156 and is attached thereto by fasteners 142.

Pockets 130 are formed in outer cylindrical surface 132 of crankcase central portion 129 by any suitable method, and disposed therein are movable contact elements or rollers 146, which may be identical to rollers 114 of the first embodiment. Pockets 130 are similar to pockets 110, and include semicircular pocket portions 134 having flats 136 extending therefrom and terminating at outer surface 132. A pair of pockets 130 are provided in outer surface 132 approximately 180 degrees from one another, however, any suitable number or distribution of pockets 130 may be provided in crankcase central portion 129.

Figure 7:
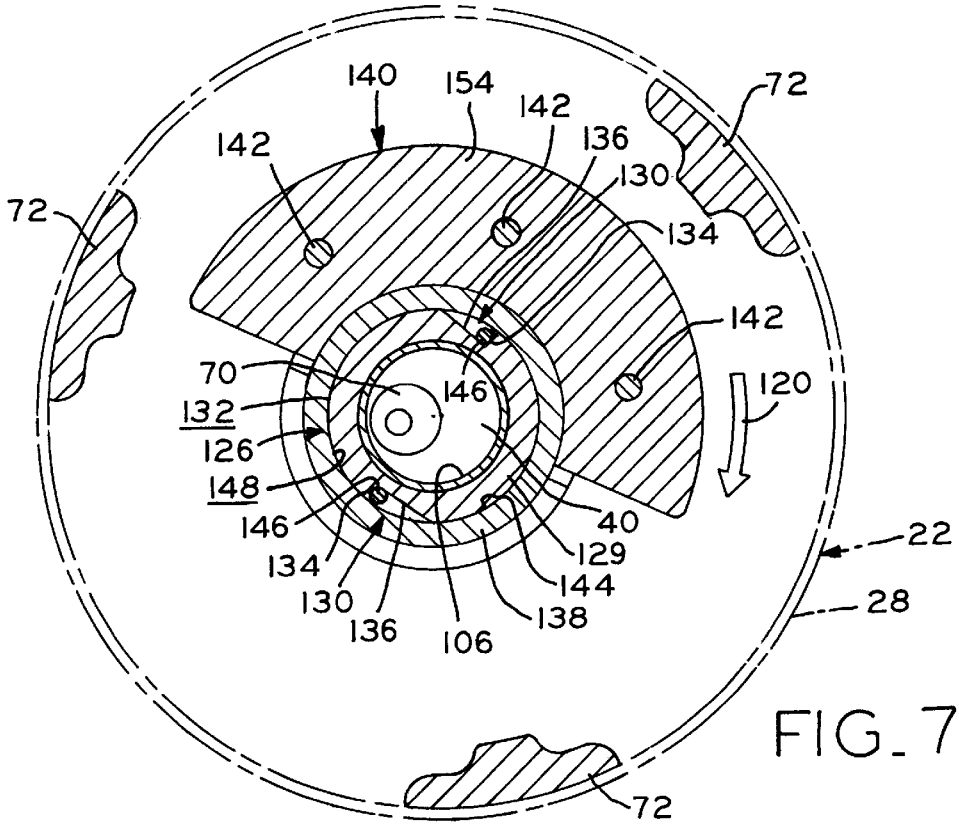
FIG. 7 is a sectional view of the brake assembly of FIG. 6 along line 7—7 showing forward rotation.
Figure 8:
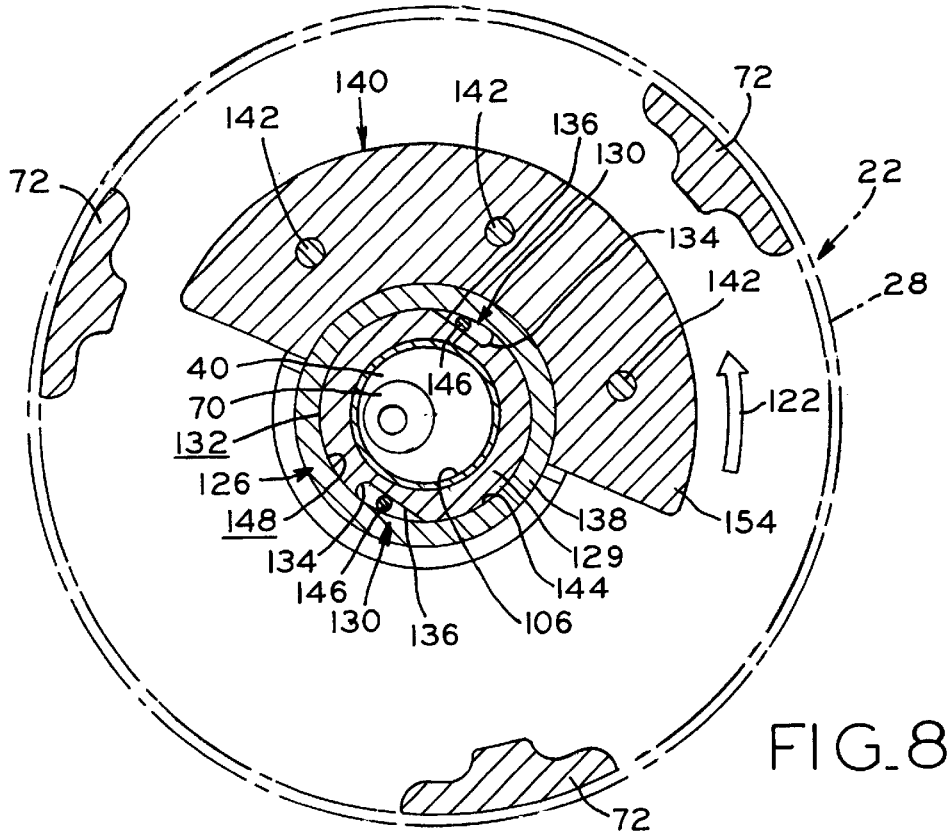
FIG. 8 is a sectional view of the brake assembly of FIG. 7 showing arrested reverse rotation.

Referring to FIG. 7, when orbiting scroll member 60 is operated in a forward direction, as indicted by arrow 120, rollers 146 remain in semicircular pocket portions 134, out of contact with brake element 138. The rotation of drive shaft 40 imparts rotary motion to counterweight 140 and thus to brake element 138 in a forward direction. During forward rotation, movement of brake element 138 in the direction of arrow 120 causes rollers 146 to be maintained within semicircular pocket portion 134 so as not to impede rotation of orbiting scroll member 60. Referring to FIG. 8, when compressor 20 is shut down, reexpansion of already compressed gas may induce reverse rotation of orbiting scroll member 60. At the onset of reverse rotation in the direction indicated by arrow 122, as brake element 138 reversely rotates, rollers 146 will be rolled out of semicircular pocket portions 134 along flats 136 by an oil film drag force acting between cylindrical inner brake element surface 148 and rollers 146. After moving out of pocket portions 134, rollers 146 will engage flats 136 and inner surface 148 of brake element 138, providing binding engagement therebetween. The binding engagement stops reverse rotation of brake element 138, drive shaft 40, and orbiting scroll member 60.

Referring to FIGS. 9–13, a third embodiment of the reverse rotation brake is illustrated. Reverse rotation brake 158 is similar to reverse rotation brake 102 in that it is positioned within cavity 104 formed in crankcase central portion 128 of crankcase 62. Reverse rotation brake 158 includes brake element 160 which is cup-shaped, having base 162 and cylindrical side wall 164. Side wall 164 is integrally formed with and stands approximately perpendicularly from base 162. Brake 158 further includes pockets 168 formed in radially outer surface 166 of cylindrical side wall 164. Movable contact elements or rollers 170 of reverse rotation brake 158 are received in pockets 168, between brake element 160 and inner cylindrical surface 124 of cavity 104. Rollers 170 may be identical to rollers 114 of the first embodiment. Brake element 160 may be constructed by casting and machining, or powdered metal techniques.

Axially extending through base 162 is hole 172 into which upper end 54 of drive shaft 40 is received. Hole 172 is formed in brake element 160 concentrically with centerline of its outside diameter and of center portions 128 and 129 of crankcase 62. A plurality of internal splines 174 are formed in base 162 about the periphery of hole 172 and mesh with a plurality of external splines 176 formed about the periphery of shaft upper portion 54. Splines 174 and 176 interfit to rotatably fix brake element 160 and drive shaft 40.

As illustrated in FIG. 9, brake element 160 includes cavity 178 in which roller 68, eccentric crankpin 70, bearing 74, and orbiting scroll member hub 76 are all received.

Figure 12:
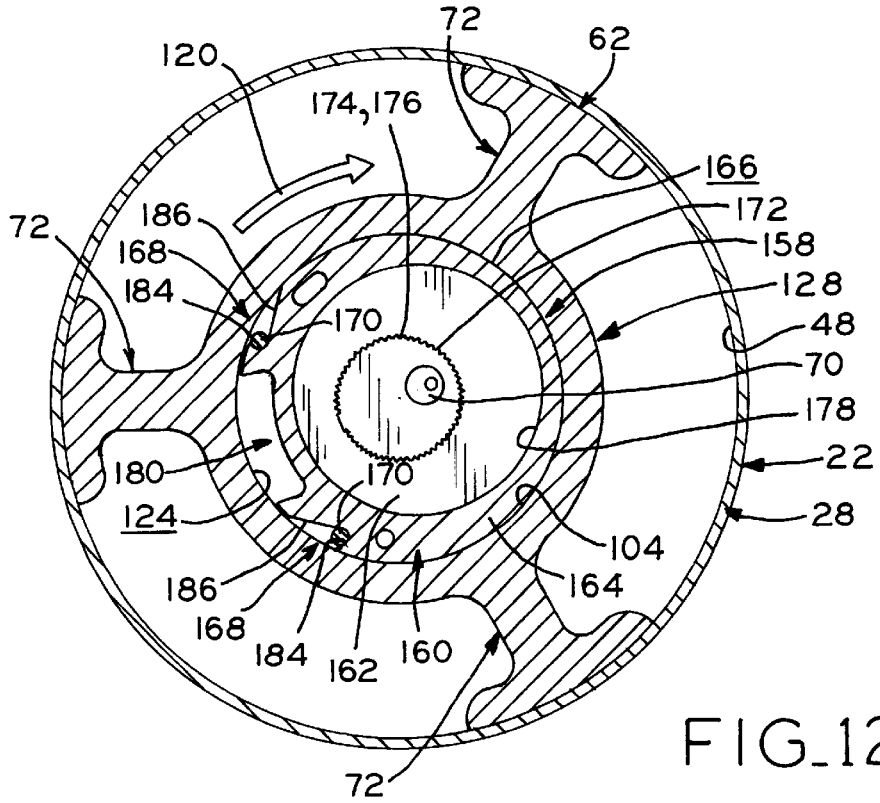
FIG. 12 is a sectional view of the compressor assembly of FIG. 9 along line 12—12 showing forward rotation.
Figure 13:
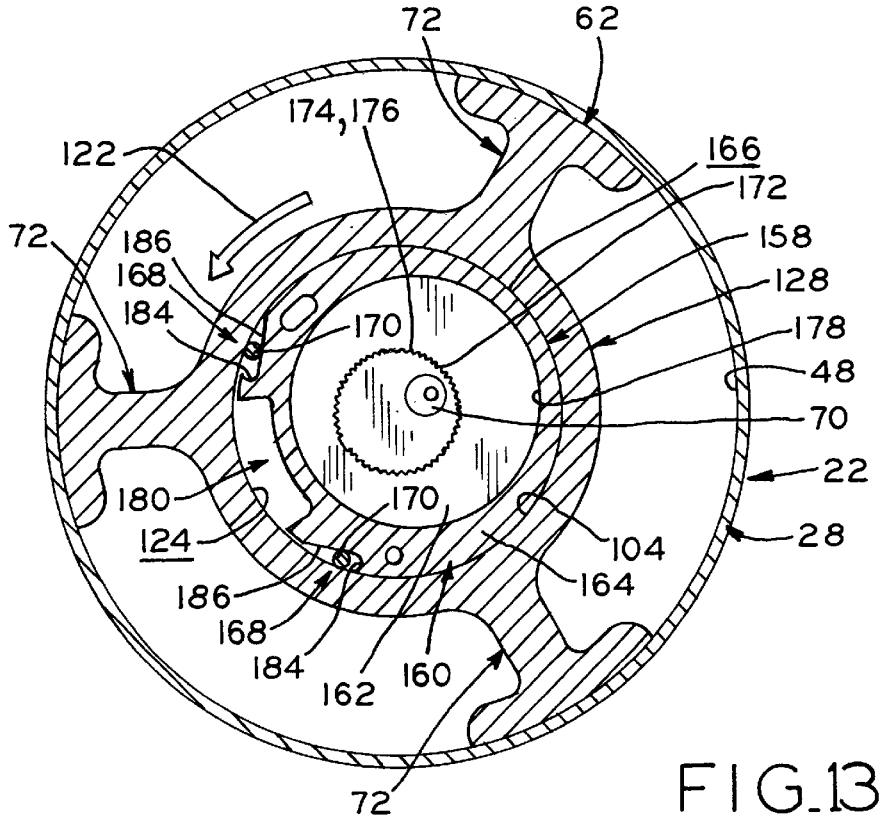
FIG. 13 is a sectional view of the compressor assembly of FIG. 12 showing arrested reverse rotation.

Referring to FIGS. 10–13, cylindrical side wall 164 of brake element 160 has radially thicker portion 180 in which pockets 168 are located. Pockets 168 include semicircular pocket portion 184 and flat portion or flat 186 which extends from semicircular pocket portion 184, terminating at outer cylindrical surface 166 of brake element 160. Pockets 168 are formed in brake element 160 in any suitable manner. Brake element 160 is illustrated as having two pockets 168, however, any suitable number of pockets may be provided. As illustrated in FIGS. 9, 12, and 13, rollers 170 are cylindrical and have a diameter slightly smaller than the diameter of semicircular pocket portions 184. This allows rollers 170 to be easily moved into and out of semicircular pocket portions 184 as discussed hereinbelow.

In operation, when hub 76 of orbiting scroll member 60 is rotated in a forward direction as indicated by arrow 120 illustrated in FIG. 12, rollers 170 are received in semicircular portions 184. The rotation of drive shaft 40 imparts forward rotary motion to orbiting scroll member 76 via roller 68, eccentric crankpin 70, bearing 74, and orbiting scroll member hub 76. The splined connection between drive shaft 40 and brake element 160 transmits rotation of drive shaft 40 to brake element 160, thereby causing rollers 170 to remain within semicircular pocket portions 184. With rollers 170 located in semicircular pocket portions 184, rollers 170 are out of contact with crankcase portion 128 so as not to impede motion of orbiting scroll member 60.

Referring to FIG. 13, when compressor 20 is shut down, reexpansion of compressed gas may cause orbiting scroll member hub 76 to move in a reverse direction indicated by arrow 122. At the onset of reverse rotation, the inertia of rollers 170 will cause them to roll out of semicircular pocket portions 184 along flats 186. Rollers 170 will reach a point along flats 186 where they will engage both flats 186 and surface 124 of cavity 104. At this point of engagement, rollers 170 provide binding engagement between crankcase 62 and brake element 160, thereby arresting reverse rotation of brake element 160 and thus orbiting scroll member 60. As the reverse rotation of brake element 160 is stopped, the splined engagement between drive shaft 40 and brake element 160 also arrests the reverse rotation of drive shaft 40.

By using a separate brake element rather than one-way bearings engaging and supporting drive shaft 40 as part of the reverse rotation brake, friction forces acting on drive shaft 40 during normal compressor operation are reduced, thereby decreasing the amount of wear on shaft 40 and improving compressor efficiency.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of arresting reverse motion of the orbiting scroll of a scroll compressor comprising:

moving an orbiting scroll member of a compression mechanism of the scroll compressor in a forward direction while rotating a brake element in the forward direction relative to a crankcase supporting the compression mechanism;

maintaining a plurality of movable contact elements in contact with only one of the brake element and the crankcase during rotation of the brake element in the forward direction;

initiating reverse motion of the orbiting scroll member;

moving the movable contact elements into binding engagement with the brake element and the crankcase while initiating rotation of the brake element in the reverse direction; and arresting reverse motion of the orbiting scroll member.

2. The method of claim 1, further comprising moving the movable contact elements into binding engagement with an inner cylindrical surface of the brake element and an outer cylindrical surface of the crankcase.

3. A scroll compressor comprising:

a compressor housing;

a compression mechanism disposed in said housing and including a fixed scroll member and an orbiting scroll member;

a motor disposed in said housing;

a drive shaft rotatively coupling said motor and said compression mechanism;

a crankcase disposed in said housing, said compression mechanism connected to said crankcase;

a brake element operatively engaged with said crankcase, said orbiting scroll member and said brake element being mechanically associated with each other to have coincident movements; and a plurality of rollers located between said brake element and said crankcase;

wherein said rollers each have a first position relative to one of said brake element and said crankcase when said compressor operates in a forward direction, in which forward motion of said orbiting scroll member is unimpeded, and, at the onset of reverse orbiting scroll member motion, said rollers each have an assumed second position relative to said one of said brake element and said crankcase, in which each said roller is in binding engagement with said brake element and said crankcase, whereby reverse motion of said orbiting scroll member is arrested.

4. The compressor of claim 3, wherein said brake element is located between interfacing surfaces of said orbiting scroll member and said crankcase, said crankcase surrounding said brake element.

5. The compressor of claim 3, wherein said brake element further comprises a substantially cylindrical outer surface, a plurality of pockets formed in said substantially cylindrical outer surface in which said rollers are received, said pockets each including a substantially semicircular portion and a substantially flat portion extending from said pocket substantially semicircular portion to said brake element substantially cylindrical outer surface.

6. The compressor of claim 5, wherein said brake element further comprises an eccentric hole therein relative to said substantially cylindrical outer surface, a portion of said orbiting scroll member being received in said eccentric hole and being in sliding engagement with said brake element.

7. The compressor of claim 5, wherein, in said roller first positions, said rollers are located in said pocket substantially semicircular portions, and in said roller second positions, said rollers are in binding engagement with said crankcase and said pocket substantially flat portions.

8. The compressor of claim 3, wherein said brake element is rotatably fixed to said drive shaft, a surface of said brake element interfacing with a surface of said crankcase, said brake element surrounding said crankcase.

9. The compressor of claim 8, further comprising a counterweight rotatably fixed to said drive shaft, said brake element mounted to said counterweight.

10. The compressor of claim 8, wherein said brake element is in splined engagement with said drive shaft.

11. The compressor of claim 8, wherein said crankcase surface is substantially cylindrical, and further comprising a plurality of pockets formed in said crankcase surface in which said rollers are received, said pockets each including a substantially semicircular portion and a substantially flat portion extending from said pocket substantially semicircular portion to said crankcase surface.

12. The compressor of claim 11, wherein in said roller first positions, said rollers are located in said pocket substantially semicircular portions, and in said roller second positions, said rollers are in binding engagement with said pocket substantially flat portions and said brake element.

13. The compressor of claim 8, wherein said brake element further comprises a substantially cylindrical outer surface, a plurality of pockets formed in said substantially cylindrical outer surface in which said rollers are received, said pockets each including a substantially semicircular portion and a substantially flat portion extending from said pocket substantially semicircular portion to said substantially cylindrical outer surface of said brake element.

14. The compressor of claim 13, wherein, in said roller first positions, said rollers are located in said pocket substantially semicircular portions, and in said roller second positions, said rollers are in binding engagement with said crankcase and said pocket substantially flat portions.

15. A scroll compressor comprising:

a compressor housing;

a compression mechanism disposed in said housing and including a fixed scroll member and an orbiting scroll member;

a motor disposed in said housing;

a drive shaft rotatively coupling said motor and said compression mechanism;

a crankcase disposed in said housing, said compression mechanism connected to said crankcase;

a brake element located between said orbiting scroll member and said crankcase; and at least one roller located between said brake element and said crankcase;

wherein said brake element has a substantially cylindrical outer surface in which at least one pocket is formed, said roller disposed in said pocket, said roller having a first position in said pocket in which forward motion of said orbiting scroll member is unimpeded when said compressor operates in a forward direction, and, at the onset of reverse motion of said orbiting scroll member, said roller has an assumed second position in said pocket in which said roller is in binding engagement with said brake element and said crankcase, whereby reverse motion of said orbiting scroll member is arrested.

16. The compressor of claim 15, wherein said brake element further comprises an eccentric hole relative to its said substantially cylindrical outer surface in which said orbiting scroll member is rotatively received.

17. The compressor of claim 15, wherein said crankcase is in surrounding relationship of said brake element.

18. The compressor of claim 15, wherein said pocket includes a substantially semicircular portion and a substantially flat portion extending from said pocket substantially semicircular portion to said brake element substantially cylindrical outer surface.

19. The compressor of claim 18, wherein in said roller first position, said roller is located in said pocket substantially semicircular portion, and in said roller second position, said roller is in binding engagement with said pocket substantially flat portion and said crankcase.

20. A scroll compressor comprising:

a compressor housing;

a compression mechanism disposed in said housing and including a fixed scroll member and an orbiting scroll member;

a motor disposed in said housing;

a drive shaft operatively coupling said motor and said compression mechanism;

a crankcase disposed in said housing, said compression mechanism connected to said crankcase;

a brake element fixedly coupled to said drive shaft, said brake element located between said orbiting scroll member and said crankcase; and at least one roller located between said brake element and said crankcase;

wherein said brake element has a substantially cylindrical outer surface in which at least one pocket is formed, said roller disposed in said pocket, said roller having a first position in said pocket in which forward motion of said orbiting scroll member is unimpeded when said compressor operates in a forward direction, and, at the onset of reverse motion of said orbiting scroll member, said roller has an assumed second position in said pocket in which said roller is in binding engagement with said brake element and said crankcase, whereby reverse motion of said orbiting scroll member is arrested.

21. The compressor of claim 20, wherein said brake element is cup-shaped having a base and a cylindrical side wall standing approximately perpendicularly from said base, a concentric hole relative to said substantially cylindrical outer surface located in said base in which said drive shaft is received, said crankcase surrounding said brake element.

22. The compressor of claim 21, further comprises a plurality of splines located about the periphery of said concentric hole, said splines meshing with a plurality of splines located about the periphery of said drive shaft.

23. The compressor of claim 20, wherein said pocket includes a substantially semicircular portion and a substantially flat portion extending from said pocket substantially semicircular portion to said brake element substantially cylindrical outer surface.

24. The compressor of claim 22, wherein in said roller first position, said roller is located in said pocket substantially semicircular portion, and in said roller second position, said roller is in binding engagement with said pocket substantially flat portion and said crankcase.

25. A method of arresting reverse motion of the orbiting scroll of a scroll compressor comprising:

moving an orbiting scroll member of a compression mechanism of the scroll compressor in a forward direction while rotating a brake element in the forward direction relative to a crankcase supporting the compression mechanism;

maintaining a movable contact element in contact with one of the brake element and the crankcase;

initiating reverse motion of the orbiting scroll member;

moving the movable contact element into binding engagement with the brake element and the crankcase while initiating rotation of the brake element in the reverse direction;

arresting reverse motion of the orbiting scroll member; and moving the movable contact element into binding engagement with an outer cylindrical surface of the brake element and an inner cylindrical surface of the crankcase.

* * * * *